United States Patent [19]

Bates

[11] Patent Number: 5,012,790

[45] Date of Patent: May 7, 1991

[54] BASEBALL PRACTICE MECHANISM

[76] Inventor: Michael R. Bates, P.O. Box 72, New Haven, Ill. 62867

[21] Appl. No.: 371,063

[22] Filed: Jun. 26, 1989

[51] Int. Cl.[5] ..... F41B 4/00

[52] U.S. Cl. ..... 124/81; 124/78; 124/6; 273/26 D

[58] Field of Search ..... 124/81, 78, 6, 49, 10, 124/82, 1; 273/26 D

[56] References Cited

U.S. PATENT DOCUMENTS

| | | | |
|---|---|---|---|
| Re. 30,703 | 8/1981 | Paulson et al. | 124/81 X |
| 1,211,738 | 1/1917 | Marty | 124/6 |
| 4,077,386 | 3/1978 | Berliner | 124/78 |
| 4,197,827 | 4/1980 | Smith | 124/78 |
| 4,323,047 | 4/1982 | McIntosh et al. | 124/81 X |
| 4,323,048 | 4/1982 | Saito et al. | 124/78 |
| 4,583,514 | 4/1986 | Nozato | 124/78 |
| 4,655,190 | 4/1987 | Harris | 124/78 |
| 4,705,014 | 11/1987 | Kahelin | 124/81 X |
| 4,760,835 | 8/1988 | Paulson et al. | 124/78 |

*Primary Examiner*—Peter M. Cuomo
*Attorney, Agent, or Firm*—Warren D. Flackbert

[57] ABSTRACT

A baseball practice mechanism defined by a tripod mounted framework supporting a baseball propelling arrangement and including a pivotal structure controlling a desired training need, as, for example, flyballs, batting practice, grounders, or the like. The tire speed is accomplish by use of an adjustment thread cooperatively engaging a pivotal plate which bears against the housing of a power source, serving, in end purposes, as a variable speed control for the rotation of the baseball propelling tire. Baseball feeding is accomplished through an entry opening into a V-shaped cup, providing safety to the user and, at the same time, the positive and repetitious squeezing, and propelling, of the baseball in a controlled direction through simple pivotal action. The mechanism is mobile through pulling movement of one or more of the tripod base legs combined with the rotating action afforded by the tire.

7 Claims, 1 Drawing Sheet

BASEBALL PRACTICE MECHANISM

BACKGROUND OF THE INVENTION

As is known, it is a continual desire on the part of a baseball player to improve skills, as in catching fly balls, grounders and batting and, as well, for infield training and/or batting cage practice. A variety of equipment is commonly available to achieve the aforesaid goals but such, typically, are defective for one reason or another as, for example, in operation, reliability, portability, and/or in achieving the desired adjustment required for baseball speed.

SUMMARY OF THE INVENTION

The invention overcomes the aforesaid difficulties and presents a baseball practice mechanism which evidences accuracy and simplicity, while, at the same time, accommodates and/or simulates situations the player encounters during a typical baseball game. Basically, effective adjustments are required for positive baseball propelling and speed and for ascertaining baseball height, as in the strike zone.

The mechanism presented by the invention achieves simulated fly balls and grounders and is usable both in field training and/or batting cage practice. The mechanism is readily moved and throws more accurately, but is still available at a lesser cost to the purchaser than other types of similar equipment.

Moreover, the invention, being versatile in end usage, promotes accuracy; presents capable head and pivotal requirements; allows the use of a regular (boat trailer) tire for ball propelling; presents a mechanical drive system utilizing a screw adjustment for a precise speed control; provides the ability to roll, but is stationary during use; and, importantly, offers inherent safety in connection with the baseball receiving cup.

BRIEF DESCRIPTION OF THE DRAWINGS

In any event, a better understanding of the present invention will become more apparent from the following description, taken in conjunction with the accompanying drawing, wherein.

Figures 1, 2:
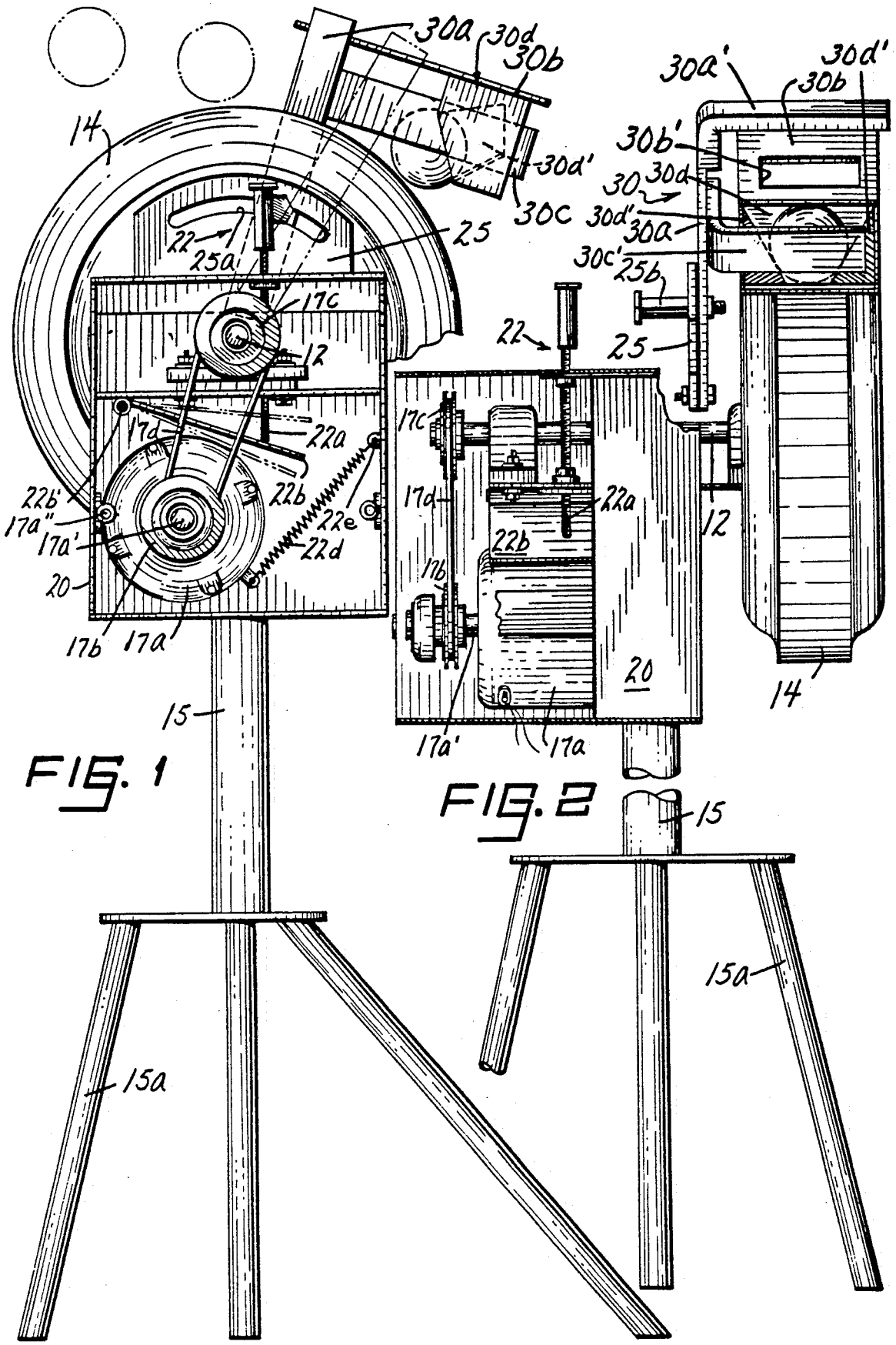
FIG. 1 is a view in side elevation of a baseball practice mechanism in accordance with the teachings of the present invention; and, FIG. 2 is a view in side elevation, looking from right to left in FIG. 1, further detailing the invention.

For the purposes of promoting an understanding of the principles of the invention, reference will now be made to the embodiment illustrated in the drawing and specific language will be used to describe the same. It will nevertheless be understood that no limitations of the scope of the invention is thereby intended, such alterations and further modifications in the illustrated device, and such further applications of the principles of the invention as illustrated therein being contemplated as would normally occur to one skilled in the art to which the invention relates.

DETAILED DESCRIPTION OF THE PREFERRED EMBODIMENT

Referring to the figures, the baseball practice mechanism of the invention is defined by an upstanding frame member 15 disposed on legs 15*a*, in the form of a tripod, the latter lending both to sturdiness and portability.

As evident in the figures, and particularly FIG. 2, the upper portion of framework 15 supports a rotatable tire support shaft 12 onto which a common treaded (boat trailer) tire 14 is disposed at the outer end thereof. In order to rotate the tire 14, and again looking at FIG. 2, a drive arrangement 17, within a housing 20, includes a drive motor 17*a* and a variable speed pulley defined by pulleys 17*b*, 17*c* and belt 17*d*. Pulley 17*b* is mounted on drive motor shaft 17*a*', while pulley 17*c* is mounted on tire support shaft 12.

The speed of rotation of the tire 14 and, hence, the tire support shaft 12, is responsive to a screw assembly 22 which produces precision speed control, i.e. the slightest variation of tire 14 speed creates a significant difference in the quality of the baseball being pitched.

More specifically, an adjustment screw 22*a*, extending into housing 20, is in continual engagement with a plate 22*b*, pivotal at 22*b*', abutting the drive motor 17*a*, the body of which is also pivotal, but at 17*a*''. A tension spring 22*d*, connecting the body of the drive motor 17*a* and a hook 22*e* disposed on the inside of the housing 20, continually urges the drive motor 17*a* towards engagement with the plate 22*b*.

When screw 22*a* is rotated in one direction, the plate 22*b* moves, for example, downwardly, causing movement of the body of the drive motor 17*a*, with the result that the belt 17*d* moves more deeply into pulleys 17*b*, 17*c*. The preceding slows the degree of tire support shaft 12 and tire 14 rotation, which, in turn, produces a slow baseball speed. The converse is true with the rotation of the screw 22*a* in an opposite direction, where, in FIG. 1, different positions of the pivotal plate 22*a* are evident from the solid line and the phantom line showings.

A plate member 25, including an arcuate slot 25*a*, is secured to a portion of the housing 20. A baseball propelling directional control assembly 30 is supported on the plate member 25 which, through bolt-nut 25*b* release, is selectively pivotal to various locations around the tire 14 representative of the direction of baseball movement.

More specifically, the directional control assembly 30 includes a member 30*a* operationally connecting with bolt-nut 25*b* and having a portion 30*a*' extending over the tire 14. An elongated plate member 30*b* extends rearwardly from member 30*a* and presents an opening 30*b*', typically 3" square, for receiving a baseball. It should be noted that with modification of opening size, the instant mechanism can be employed for other than baseball usages.

In any event, another plate member 30*c* extends rearwardly in a generally parallel relationship with plate member 30*b*, but blends into a laterally extending end portion 30*c*', serving part of a receiving cup 30*d*, where the latter is defined by converging side walls 30*d*' emptying into an opening which permits passage of the baseball onto the rotating tire 14.

In a use condition, therefore, the directional control assembly 30 is rotated, by release of bolt-nut 25*b*, to the desired ball position, as for simulating ground balls, flyballs, and the like. The baseball is placed through the opening 30*b*' and into the receiving cup 30*d*. Irrespective of the position of the directional control assembly 30, the baseball always maintains the same distance from the tire 14 (typically ¼") to afford ball propelling from any position with correct accuracy. The desired speed of the rotating tire 14 has already been established through use of the screw assembly 22.

In any event, the baseball, after being placed in the receiving cup 30*d* is released and, thereupon, will travel the aforesaid ¼" distance and be grabbed by the tire 14. The baseball will then be squeezed against the head of directional control assembly 30 (at plate member 30*b*) and the baseball launched with a backspin thereon.

Such an arrangement has a significant effect upon baseball movement accuracy, where, for example, and in contrast with a former machine utilizing a tube, the baseball in the latter reaches the tire while rolling, causing the baseball to propel high or upwardly. If the baseball is placed gently into the tube, the baseball speed is slower when it reaches the tire and the result will be a low moving baseball. Thus, such former system provides no accuracy.

Restated otherwise, the invention requires the setting of the baseball in the receiving cup for immediate pickup by the spinning tire 14. It is impossible to either shove or gently place the baseball in a propelling position. Importantly, therefore, the pickup always remains the same.

As a matter of example, the exit opening of the head of the directional control assembly 30 typically presents a 2" dimension between the forward end of plate member 30*b* and the tire 14, resulting in a ¾" squeeze (on the baseball) which is critical for optimum baseball training. As stated, the squeeze importantly (both for accuracy and safety) produces the correct backspin to the baseball.

In other words, if the baseball has too much backspin, it will rise as it travels to the batter, causing the baseball to be too high to hit for training. The correct backspin is also critical for fielding grounders, since the baseball will break its speed upon hitting the ground. If, on the other hand, a forward rotation is employed, the baseball will accelerate when it hits the ground, causing possible injury.

As to portability, upon locking the directional control assembly 30 in a rearward position, by bolt-nut 25*b*, and moving the mechanism to a laying position, two of the legs can be grasped and the tire 14 employed for rolling action and, hence, movement to a desired location.

It should be evident, therefore, that the mechanism presented herein serves importance to baseball training, where such is susceptible to various changes within the spirit of the invention, including, by way of example, in proportioning; the particular configuration of the directional control assembly; alternative approaches to achieve tire speed control; and, the like. Thus, the preceding should be considered illustrative and not as limiting the scope of the following claims:

I claim:

1. A baseball practice mechanism comprising a framework supporting a baseball propelling tire, means for rotating said tire, a speed control for said rotating tire defined by a pivotal plate, means normally urging said rotating means towards said pivotal plate, and a threaded adjustment selectively bearing against said pivotal plate to achieve a variable and uninterrupted speed function upon movement of said rotating means, and a pivotal baseball directional control assembly disposed on said framework movable to positions representative of hitting practice, ground ball practice and fly ball practice and including a plate member having an opening through which a baseball is introduced by simple operator release, serving a consistent successive baseball entry relationship and operative baseball engagement with said tire, where said operative engagement of said baseball with said tire is independent of any said movement of said speed control.

2. The baseball practice mechanism of claim 1 wherein said urging means is a tension spring.

3. The baseball practice mechanism of claim 1 wherein said baseball is squeezed from a head member of said pivotal baseball directional control assembly.

4. The baseball practice mechanism of claim 1 where said pivotal baseball directional control assembly overlies said tire.

5. A baseball practice mechanism comprising a framework supporting a baseball propelling tire, means for rotating said tire, a speed control for said rotating tire defined by a pivotal plate, means normally urging said rotating means towards said pivotal plate, and a threaded adjustment selectively bearing against said pivotal plate to achieve a variable speed function upon movement of said rotating means, and a pivotal baseball directional control assembly disposed on said framework including a plate member having an opening through which a baseball is introduced for operative engagement with said tire, where said operative engagement of said baseball with said tire is independent of any said movement of said speed control, and where said pivotal baseball directional control assembly including said plate member having said opening adapted for passage of a baseball into a cavity having converging walls emptying directly onto said tire.

6. The baseball practice mechanism of claim 5 where the exit of said cavity remains a fixed distance from said tire.

7. A baseball practice mechanism comprising a framework supporting a baseball propelling tire, means for rotating said tire, a speed control for said rotating tire defined by a pivotal plate, means normally urging said rotating means towards said pivotal plate, and a threaded adjustment selectively bearing against said pivotal plate to achieve a variable speed function upon movement of said rotating means, and a pivotal baseball directional control assembly disposed on said framework including a plate member having an opening through which a baseball is introduced for operative engagement with said tire, where said operative engagement of said baseball with said tire is independent of any said movement of said speed control, where said pivotal baseball directional control assembly including said plate member having said opening adapted for passage of a baseball into a cavity having converging walls emptying directly onto said tire and presents an exit defined by the space between said plate member and said tire and arranged dimension-wise to produce a backspin on the ejected baseball.

* * * * *